US009097002B2

(12) United States Patent
Weithaller

(10) Patent No.: US 9,097,002 B2
(45) Date of Patent: Aug. 4, 2015

(54) DOUBLE-LOCK RAIL

(75) Inventor: Guillaume Weithaller, Dessenheim (FR)

(73) Assignee: NORMALU (SAS), Kembs (FR)

( * ) Notice: Subject to any disclaimer, the term of this patent is extended or adjusted under 35 U.S.C. 154(b) by 0 days.

(21) Appl. No.: 13/386,627

(22) PCT Filed: Jul. 22, 2010

(86) PCT No.: PCT/FR2010/000531
§ 371 (c)(1),
(2), (4) Date: Apr. 5, 2012

(87) PCT Pub. No.: WO2011/010022
PCT Pub. Date: Jan. 27, 2011

(65) Prior Publication Data

US 2012/0180421 A1 Jul. 19, 2012

(30) Foreign Application Priority Data

Jul. 22, 2009 (FR) ..... 09 03614

(51) Int. Cl.
*E04B 2/00* (2006.01)
*E04B 9/30* (2006.01)
*E04F 13/00* (2006.01)

(52) U.S. Cl.
CPC ..... *E04B 9/303* (2013.01); *E04F 13/005* (2013.01)

(58) Field of Classification Search
CPC ..... E04B 9/303; E04B 9/30; E04F 13/005
USPC ..... 52/63, 222, 273, 831, 836, DIG. 8, 52/DIG. 9, 506.06; 160/327, 328, 391, 160/392, 57
See application file for complete search history.

(56) References Cited

U.S. PATENT DOCUMENTS

| | | | | |
|---|---|---|---|---|
| 4,333,284 | A * | 6/1982 | Meadows | 52/222 |
| 4,426,760 | A | 1/1984 | Watts | |
| 4,690,192 | A * | 9/1987 | Stilling | 160/57 |
| 5,029,422 | A * | 7/1991 | Scherrer | 52/222 |
| 5,242,004 | A * | 9/1993 | Stilling | 160/57 |
| 7,607,268 | B2 * | 10/2009 | Scherrer et al. | 52/273 |
| 8,056,602 | B1 * | 11/2011 | Green | 160/392 |
| 2011/0061320 | A1 * | 3/2011 | Scherrer | 52/222 |

FOREIGN PATENT DOCUMENTS

| | | | |
|---|---|---|---|
| EP | 0338925 | A1 | 10/1989 |
| EP | 0683287 | A1 | 11/1995 |
| FR | 2844286 | A1 | 3/2004 |
| WO | 99/24722 | A1 | 5/1999 |

OTHER PUBLICATIONS

English Abstract of EP0683287 retrieved from Espacenet on Apr. 5, 2012.
English Abstract of FR2844286 retrieved from Espacenet on Apr. 5, 2012.
International Search Report from PCT/FR2010/000531 dated Nov. 8, 2010.

* cited by examiner

*Primary Examiner* — Brian Glessner
*Assistant Examiner* — Brian D Mattei
(74) *Attorney, Agent, or Firm* — Bachman & LaPointe, P.C.

(57) ABSTRACT

The present invention relates to a heddle (32) for a stretched fabric false wall provided with a harpoon that includes an inner arm, by means of which the harpoon is connected to the periphery of said fabric, and a curved outer arm, said heddle (32) including at least two peripheral vertical flanges (34) that extend downward and define at least one downwardly opening recess, and at least one shoulder (39) for receiving the bottom end of the outer arm when the fabric is stretched, said heddle (32) being characterized in that it includes two peripheral vertical flanges (34) and a central vertical flange (35), said flanges (34, 35) extending downward and defining two downwardly opening recesses, and in that each of said peripheral vertical flanges (34) includes a shoulder (39) on the inner surface thereof, and in that said central vertical flange (35) includes a shoulder (36) on each of the surfaces thereof.

6 Claims, 3 Drawing Sheets

DOUBLE-LOCK RAIL

TECHNICAL FIELD

This invention relates to a rail for a stretched fabric false wall, and in particular for a stretched fabric false ceiling, as well as a false wall comprising a stretched fabric connected to at least one rail.

BACKGROUND

False ceilings conventionally include one or several rails for hooking which are fastened on each of the walls of a room, and an elastic fabric, for example en polyvinyl chloride (PVC), which is deformed via tension so that its ends, provided with means of hooking, can be fastened to the rails using these means of hooking. However, false ceilings often have the disadvantage of leaving visible at least one portion of the rail for hooking. In order to overcome this disadvantage, false ceilings intended to conceal the rail for hooking have been developed. Such a false ceiling, such as shown in FIG. 1, comprises a rail 2 intended to fasten a stretched fabric 1 made of polyvinyl chloride. This type of rail is also known as an "intermediary rail" as they allow for the fastening of two contiguous sheets. The rail 2 comprises two peripheral vertical flanges 4 for fabric support, a central vertical flange 5 for receiving fabric which is fastened in the upper portion of a wall 3 by means of fastening, such as screws. The peripheral vertical flanges 4 for fabric support and the central vertical flange 5 for receiving fabric are connected together by a horizontal core 8. The central vertical flange 5 for receiving fabric is provided with a shoulder 6, which, with the peripheral vertical flange 4 for fabric support, allows for the installation of the fabric 1. The shoulder 6 extends horizontally from the base of the flange 5 for receiving fabric in the direction of the exterior of the rail 2. The fabric 1 is fastened to the rail 2 thanks to a harpoon 7 which is arranged at the periphery of the fabric 1.

This false ceiling, although it constitutes undeniable progress in the aesthetics for fastening the stretched fabric, is not entirely satisfactory, as the rail in question allow only for a single configuration and can be used only as an intermediary rail and it is not possible to use it as a wall rail. In addition, the space between the two pieces of fabric 1 is particularly unattractive as it is substantial and allows the central vertical flange 5 to appear. In order to perfect the aesthetics of the whole, it is necessary to install a cover 9.

SUMMARY

This invention proposes a rail making it possible to overcome these disadvantages. The invention as such has for object a rail for a stretched fabric false wall provided with a hook-shaped harpoon comprising an inner arm by means of which it is connected to the periphery of said fabric and a curved outer arm, said rail comprising at least two peripheral vertical flanges extending downward defining at least one downwardly opening recess and at least one shoulder intended to receive the bottom end of the outer arm when the fabric is stretched. Said rail is remarkable in that it comprises two peripheral vertical flanges and a central vertical flange, said flanges extending downward and defining two downwardly opening recesses, in that each of said peripheral vertical flanges comprises a shoulder on its inner surface and in that said central vertical flange comprises, on each of its surfaces a shoulder.

As such the hooking of the stretched fabric can be carried out indifferently on one or the other of the peripheral vertical flanges. This represents a substantial advantage since the same rail can be used regardless of the orientation of the fabric.

According to a preferred embodiment, this invention relates to a rail for a stretched fabric false wall according to the invention remarkable in that said flange comprises two peripheral vertical flanges extending downward and a central vertical flange extending downward defining two downwardly opening recesses and in that said central vertical flange comprises, on each of its surfaces a shoulder. As such the hooking of the stretched fabric can be carried out indifferently on one or the other of the peripheral vertical flanges or on the central vertical flange. Said rail can consequently be used to fasten two contiguous pieces of fabric when the latter are hooked to the shoulders of the central vertical flange, or a single piece of fabric when the latter is hooked to one of the peripheral vertical flanges.

According to a preferred embodiment the vertical flanges are connected together by a horizontal core.

The flanges are more preferably parallel to one another and perpendicular to the core. The central and peripheral vertical flanges can extend downward to the same height or preferably the peripheral vertical flanges can extend lower than the central vertical flange. The rail can be made of any material, and in particular of metal, as for example aluminium, or of a plastic material. The rail is more preferably made of polyvinyl chloride (PVC).

The invention also has for object a false wall, and in particular a false ceiling, of the type comprising a stretched fabric connected to at least one rail described hereinabove. The fabric is more preferably provided at its periphery with a harpoon, intended to be received by the flange for receiving the fabric, in an operational configuration of the rail, in order to facilitate the reception of the fabric in the rail.

BRIEF DESCRIPTION OF THE DRAWINGS

Other purposes, characteristics and advantages of the invention shall appear when reading the following description, provided solely by way of example, and given in reference to the appended drawings, wherein.

DETAILED DESCRIPTION

Figure 1:
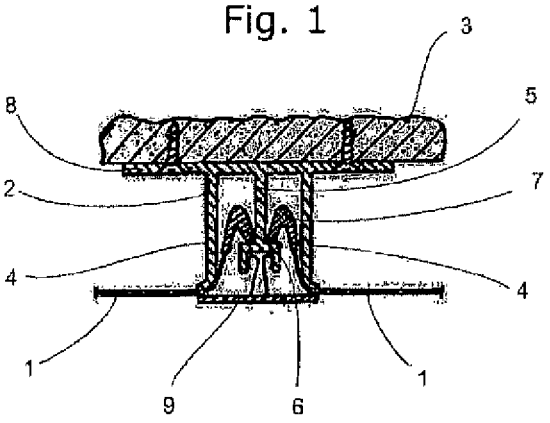
Prior Art Fig. 1
FIG. 1, already described, shows a vertical and transversal cross-section of a false ceiling comprising a stretched fabric hooked to a rail according to prior art.
Figure 2:
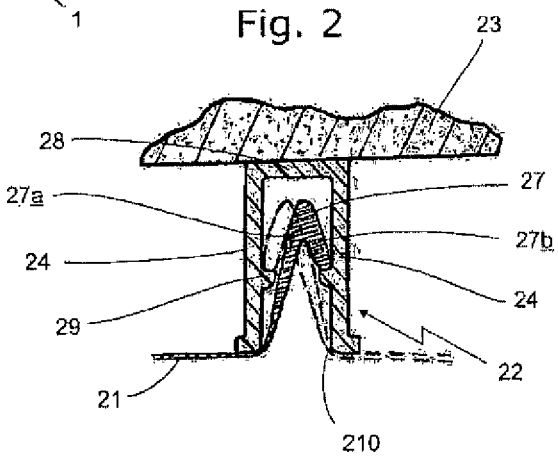
FIG. 2 shows a vertical and transversal cross-section of a false ceiling comprising a stretched fabric hooked to a rail according to a punctual execution of the invention comprising two peripheral vertical flanges.

The rail 22 according to an intermediary embodiment of the invention, such as shown in FIG. 2, comprises two peripheral flanges 24 and is fastened in a wall 23, such as for example a ceiling, by means of fastening not shown. The two peripheral flanges 24 are connected together by a horizontal core 28. The two peripheral flanges 24 can be of different or equivalent lengths. According to a preferred embodiment of the invention, the two peripheral flanges 24 are of equivalent lengths. The two peripheral flanges 24 are each provided with a shoulder 29, on the inner surface of said peripheral flanges 24 which allows for the installation of a fabric 21 made of polyvinyl chloride. The shoulders 29 can be positioned indifferently across from each other or at different heights. The two peripheral flanges 24 are preferentially provided at their bottom end with a rounded zone 210 whereon the fabric 21 comes to press against. The fabric 21 is positioned on the rail 22 thanks to a harpoon 27 which is arranged at the periphery of the fabric 21. The harpoon 27, which is advantageously made of extruded semi-flexible plastic material, has the shape of a downwardly opening hook. It comprises an inner arm 27*a* by means of which it is connected to the fabric 21 and an outer arm 27*b* curved downward. The harpoon 27 presses against, when the fabric 21 is stretched, the shoulder 29, via the bottom end of its outer arm 27*b*. The shoulders 29 are located above the bottom end of the peripheral flange 24, in order to provide the tension of the fabric 21.

Figure 3:
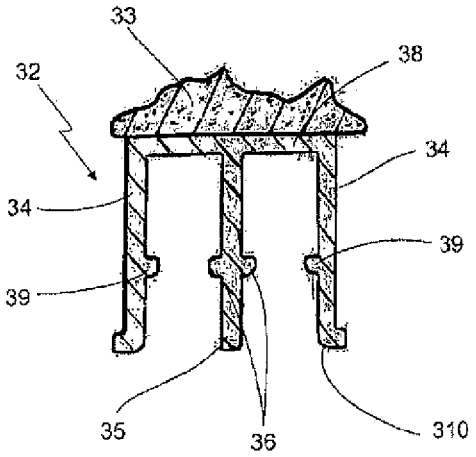
FIG. 3 shows a vertical and transversal cross-section of a rail according to the invention comprising two peripheral vertical flanges and a central vertical flange.

The rail 32 according to the invention, such as shown in FIG. 3, comprises two peripheral flanges 34 and a central vertical flange 35 extending downward defining two downwardly opening recesses which is fastened in a wall 33 by means of fastening not shown. The two peripheral flanges 34 are connected together by a horizontal core 38. The two peripheral flanges 34 are each provided with a shoulder 39, on the inner surface of said peripheral flanges 34. The vertical flange 35 comprises, on each of its surfaces a shoulder 36. According to a preferred embodiment of the rail according to the invention, the shoulders 36, 39 are placed above the bottom end of the central and peripheral flanges. The shoulders on two flanges that are across from each other can be placed indifferently across from each other or at different heights.

The two peripheral flanges 34 and the central vertical flange 35 can be of different or of equivalent lengths. According to a preferred embodiment of the invention, the two peripheral flanges 34 and the central vertical flange 35 are of equivalent lengths.

Figure 4:
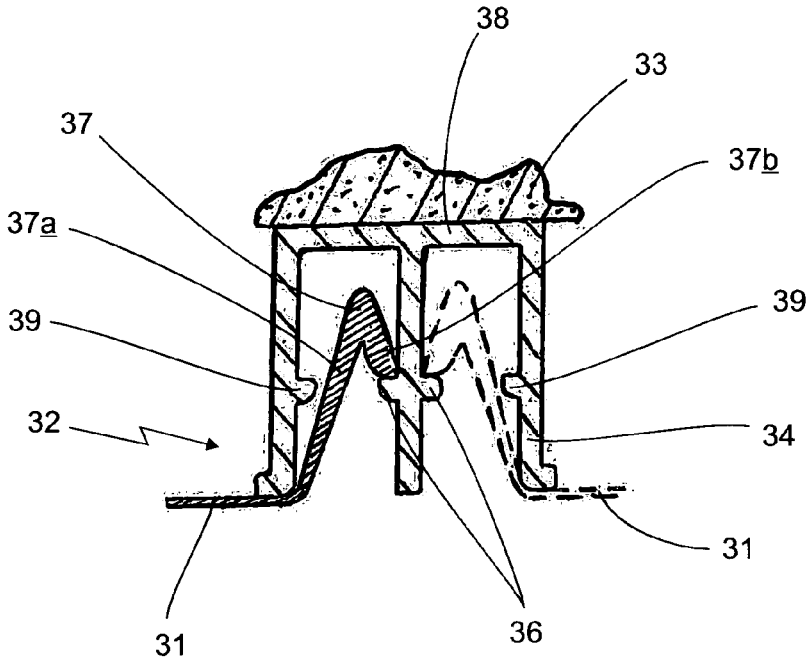
FIG. 4 shows a vertical and transversal cross-section of a configuration of a false ceiling comprising a stretched fabric hooked to a rail according to the previous figure.
Figure 5:
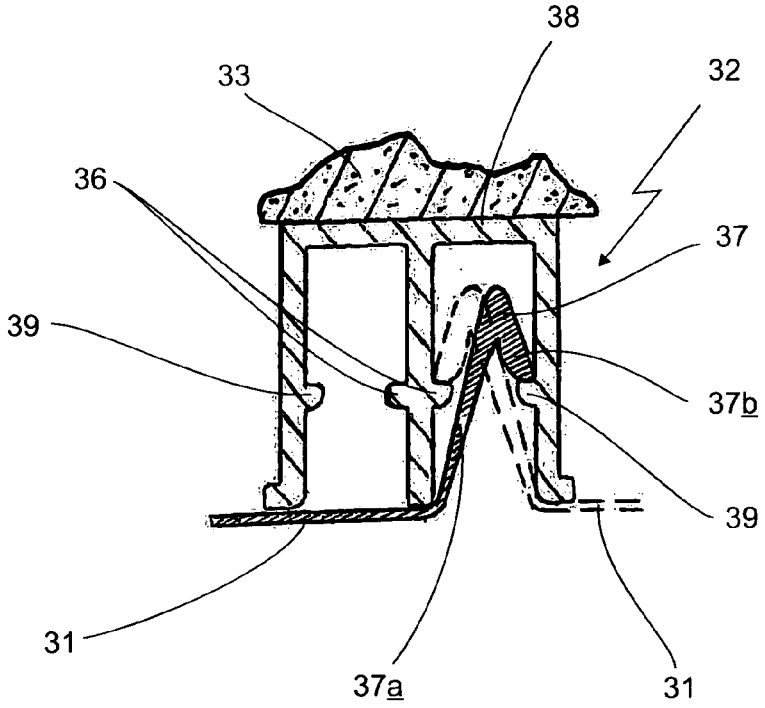
FIG. 5 shows a vertical and transversal cross-section of a second configuration of a false ceiling comprising a stretched fabric hooked to a rail according to the previous figure.

FIGS. 4 and 5 show two configurations on the extreme portion of a false wall, such as for example a false ceiling, which is constituted by a flexible fabric 31 stretched horizontally on the rail 32, such as shown in FIG. 3, thanks to a harpoon 37 which is arranged at the periphery of the fabric 31. The harpoon 37, which is advantageously made of an extruded semi-flexible plastic material, has the shape of a downwardly opening hook. It comprises an inner arm 37*a* by means of which it is connected to the fabric 31 and an outer arm 37*b* curved downward. When the fabric 31 is stretched, the harpoon 37 presses against via the bottom end of its outer arm 27*b*, either on the shoulder 39 of one of the peripheral flanges 34 or on the shoulder 36 of the vertical flange 35, according to the configuration of the false wall.

Said shoulders 39, 36 are located above respectively the bottom end of the peripheral flanges 34 and the vertical flange 35, in order to provide for the tension of the fabric 31. The two peripheral flanges 34 are preferentially provided at their bottom end of a rounded zone 310 whereon the fabric 31 comes to press.

In FIG. 5, it is understood that the vertical flange 35 can be, according to the direction of the hooking of the fabric 31, entirely concealed. This configuration reinforces the aesthetics of the false wall.

Figure 6:
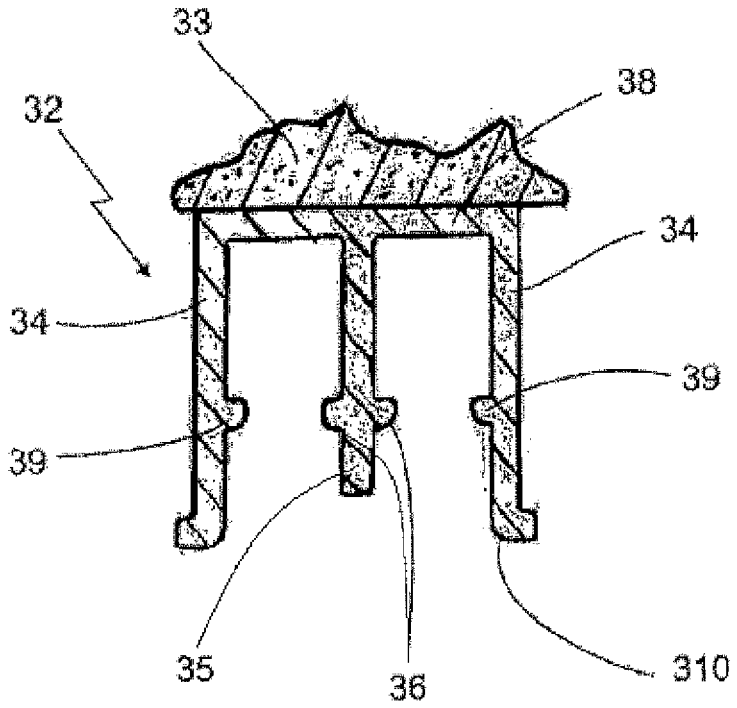
FIG. 6 shows a vertical and transversal cross-section of a rail according to the invention comprising two peripheral vertical flanges and a central vertical flange, in which the central vertical flange is of a different length than the two peripheral vertical flanges.

The rail 32 according to the invention, such as shown in FIG. 6, comprises two peripheral flanges 34 and a central vertical flange 35 extending downward defining two downwardly opening recesses which is fastened in a wall 33 by means of fastening not shown. The two peripheral flanges 34 are connected together by a horizontal core 38. The two peripheral flanges 34 are each provided with a shoulder 39, on the inner surface of said peripheral flanges 34. The vertical flange 35 comprises, on each of its surfaces a shoulder 36. According to one or more embodiments of the rail according to the invention, the shoulders 36, 39 are placed above the bottom end of the central and peripheral flanges. The shoulders on two flanges that are across from each other can be placed indifferently across from each other or at different heights.

The two peripheral flanges 34 and the central vertical flange 35 can be of different or of equivalent lengths. As shown, the two peripheral flanges 34 are of equivalent lengths and the central vertical flange 35 is of a shorter length than the two peripheral flanges 34.

Furthermore, FIGS. 2, 4 and 5 show two methods of hooking of the stretched fabric 21, 31, one in solid lines and the other in dashed lines. It is then well understood that one of the advantages of these rails 22, 32 is that the hooking of the fabric 21, 31 can be carried out indifferently on one or the other of the central and/or vertical flanges 24, 34 and 35.

Finally, it is understood that this invention is not limited to the alternative executions described, but that it can be modified or adapted according to particular needs or requirements, without however leaving the scope of the invention.

The invention claimed is:

1. A rail for stretched fabric false wall provided with a hook-shaped harpoon comprising an inner arm by means of which said harpoon is connected to a periphery of said fabric and a curved outer arm, said rail comprising two peripheral vertical flanges and a central vertical flange, each of said peripheral vertical flanges and said central flange extending downward and defining two downwardly opening recesses, said peripheral vertical flanges comprising shoulders formed on inner surfaces of each of said peripheral vertical flanges, and said central vertical flange comprises a shoulder formed on each surface of said central flange, wherein each of the shoulders on the two peripheral vertical flanges and each of the shoulders on the central flange are configured to receive the bottom end of the outer arm when the fabric is stretched, and wherein the shoulders on each of said peripheral vertical flanges are placed at the same vertical height than the shoulders of said central flange, wherein said shoulders are placed above the bottom end of the central and vertical flanges and configured to maintain the fabric stretched; the peripheral vertical flanges and the central flange are equivalent lengths.

2. Rail for stretched fabric false wall according to claim 1, wherein said vertical flanges extend downward and are of identical lengths.

3. Rail for stretched fabric false wall according to claim 1, wherein said peripheral vertical flanges and the central vertical flange extend downward and are of different lengths.

4. Rail for stretched fabric false wall according to claim 1, wherein said flanges are connected together by a horizontal core.

5. A false wall comprising:

a stretched fabric provided with a hook-shaped harpoon comprising an inner arm by means of which it is connected to the periphery of said fabric and a single curved outer arm, a rail comprising two peripheral vertical flanges and a central vertical flange, each of said peripheral vertical flanges and said central flange extending downward and defining two downwardly opening recesses, said peripheral vertical flanges comprising shoulders formed on inner surfaces of each of said peripheral vertical flanges, said central vertical flange comprises a shoulder formed on each surface of said central flange and wherein each of the shoulders on the two peripheral vertical flanges and each of the shoulders on the central flange are placed above the bottom end of the central and vertical flanges and are configured to receive the bottom end of the outer arm to maintain the fabric stretched.

6. The false wall according to claim 5, wherein the shoulders on each of said peripheral vertical flanges are placed at the same vertical height than the shoulders of said central flange.

* * * * *